US008358947B2

(12) United States Patent
Otsuka

(10) Patent No.: US 8,358,947 B2
(45) Date of Patent: Jan. 22, 2013

(54) FIXING DEVICE AND IMAGE FORMING APPARATUS HAVING IMPROVED ACCURACY OF TEMPERATURE CONTROL

(75) Inventor: Yutaka Otsuka, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 211 days.

(21) Appl. No.: 12/797,069

(22) Filed: Jun. 9, 2010

(65) Prior Publication Data

US 2010/0329720 A1 Dec. 30, 2010

(30) Foreign Application Priority Data

Jun. 30, 2009 (JP) ..... 2009-155394

(51) Int. Cl.
*G03G 15/20* (2006.01)

(52) U.S. Cl. ..... 399/69; 399/334

(58) Field of Classification Search ..... 399/45, 399/69, 70, 328, 333, 334; 219/216
See application file for complete search history.

(56) References Cited

U.S. PATENT DOCUMENTS

| | | | | |
|---|---|---|---|---|
| 5,543,904 | A | 8/1996 | Kato et al. | |
| 5,701,554 | A | 12/1997 | Tanaka et al. | |
| 7,082,272 | B2 * | 7/2006 | Takano | 399/69 |
| 7,203,438 | B2 * | 4/2007 | Omata et al. | 399/69 |
| 7,599,637 | B2 * | 10/2009 | Nanataki et al. | 399/70 |
| 2004/0033084 | A1 | 2/2004 | Akizuki et al. | |
| 2007/0122173 | A1 | 5/2007 | Mitsuoka et al. | |

FOREIGN PATENT DOCUMENTS

| | | | |
|---|---|---|---|
| JP | 04-246678 | | 9/1992 |
| JP | 04-342980 | A | 11/1992 |
| JP | 07-209928 | A | 8/1995 |
| JP | 7-295436 | A | 11/1995 |
| JP | 7-334023 | A | 12/1995 |
| JP | 08-044435 | A | 2/1996 |
| JP | 09-080966 | A | 3/1997 |
| JP | 2001-051545 | A | 2/2001 |

(Continued)

OTHER PUBLICATIONS

Office Action from Japanese Patent Office issued in corresponding Japanese Patent Application No. 2009-155394 dated Aug. 2, 2011, with an English translation thereof.

(Continued)

*Primary Examiner* — Hoang Ngo
(74) *Attorney, Agent, or Firm* — Buchanan Ingersoll & Rooney PC

(57) ABSTRACT

In a fixing device, having a sheet portion and an inter-sheet portion, heats and fixes the toner image onto each of sheets by rotationally bringing the sheet portion into contact with each sheet. A heating unit heats the fixing unit. A sensing unit senses a temperature of the fixing unit. A control unit controls a duty ratio of on/off of the heating unit based on a sensing output of the sensing unit, determines whether the sensing unit is sensing the temperature of the sheet portion or the temperature of the inter-sheet portion in a rotation cycle, and controls the temperature of the heating unit by using the adjustment value corresponding to the sheet portion or the inter-sheet portion depending on a determination result.

20 Claims, 7 Drawing Sheets

FOREIGN PATENT DOCUMENTS

| | | | |
|---|---|---|---|
| JP | 2004-198537 | | 7/2004 |
| JP | 2005-189268 | A | 7/2005 |
| JP | 2006-267941 | A | 10/2006 |
| JP | 2007-004040 | A | 1/2007 |
| JP | 2007-086473 | A | 4/2007 |
| JP | 2007-173218 | | 7/2007 |
| JP | 2008-009004 | A | 1/2008 |
| JP | 2008-134377 | A | 6/2008 |
| JP | 2008-139805 | A | 6/2008 |
| JP | 2009-025831 | | 2/2009 |

OTHER PUBLICATIONS

Office Action (Notice of Grounds of Rejection) dated Apr. 12, 2011, issued in the corresponding Japanese Patent Application No. 2009-155394, and an English Translation thereof.

Notice of Allowance (Decision to Grant Patent) dated May 18, 2012, issued in the corresponding Japanese Patent Application No. 2009-155394, and an English translation thereof.

* cited by examiner

FIXING DEVICE AND IMAGE FORMING APPARATUS HAVING IMPROVED ACCURACY OF TEMPERATURE CONTROL

This application is based on Japanese Patent Application No. 2009-155394 filed with the Japan Patent Office on Jun. 30, 2009, the entire content of which is hereby incorporated by reference.

BACKGROUND OF THE INVENTION

1. Field of the Invention

The present invention relates to a fixing device and an image forming apparatus, and particularly to a fixing device having improved accuracy of temperature control in a nip portion as well as a control device thereof and an image forming apparatus.

2. Description of the Related Art

In an image forming apparatus such as a laser printer employing a dry electrophotograph system, a toner image is formed on a record paper sheet, and is fixed thereto by a fixing device.

The fixing device generally includes a fixing roller for heating and fixing the toner image onto the record paper sheet as well as a pressing roller for pressing the sheet against the fixing roller. The record paper sheet bearing the toner image passes through a portion between the fixing and pressing rollers so that the toner image is fixed to the record paper sheet.

Various techniques have been disclosed in connection with the temperature control of the fixing and pressing rollers in the above type of fixing device.

For example, a document 1 (Japanese Laid-Open Patent Publication No. 07-295436 has disclosed a technique relating to a fixing device in which a fixing roller and a pressing roller each internally having a heat source are arranged and are vertically spaced from each other, and particularly relating to temperature control of these rollers. Specifically, when heating of both the rollers is controlled in substantially the same manner, such a situation may occur that a hot airflow or the like from the lower side to the upper side heats the roller in the lower position more strongly than the roller in the lower position. For avoiding this situation, the above document has disclosed a technique for setting a ratio between the electric powers supplied to the rollers, respectively.

The fixing device generally has a portion where the fixing and pressing rollers nip the sheet to fix the toner image onto the sheet, and this portion is generally referred to as a "nip portion". When the accuracy of the temperature control in the nip portion of the fixing device is improved, this can stabilize fixing accuracy of the toner image, and therefore can stabilize image forming performance. When ripple occurs in temperature of the nip portion, the fixing accuracy of the toner image lowers so that the image forming performance becomes unstable. Therefore, it is important to improve the accuracy of the temperature control of the nip portion.

In connection with the above, a document 2 (Japanese Laid-Open Patent Publication No. 07-334023) has disclosed a related technique. In a fixing device of the document 2, a record paper sheet passes through a portion between a heating roller and a pressing roller so that a toner image is fixed onto the record paper sheet. A heating member contained in the heating roller is supplied with an electric power proportional to a difference between its temperature and a set temperature. The temperature of the heating roller is estimated based on a quantity of electric power supplied to the heating roller in proportional control. The set temperature of the heating member changes based on the estimated temperature of the pressing roller.

In the technique disclosed in the above document 2, the heating member directly heats the heating roller in contact with the record paper sheet. The temperature of the pressing roller lowers due to nipping of the paper sheet between the heating and pressing rollers as well as other reasons, and this temperature is estimated based on the quantity of the electric power supplied to the heating member that is a target of the proportional control.

In the fixing device, it is always necessary to improve the accuracy of the temperature control of the nip portion from the viewpoint of stabilizing the image formation performance, as described above.

SUMMARY OF THE INVENTION

The present invention has been made in view of the above facts, and an object of the invention is to stabilize the image fixing performance of the fixing device and the image forming apparatus.

A fixing device comprises a fixing unit, having a sheet portion and an inter-sheet portion, for heating and fixing a toner image onto each of sheets by rotationally bringing the sheet portion into contact with each the sheet; a heating unit for heating the fixing unit; a sensing unit for sensing a temperature of the fixing unit; and a control unit for controlling a temperature of the heating unit by changing a duty ratio of on/off of the heating unit based on a sensing output of the sensing unit. The control unit includes a storage unit for storing an adjustment value of the duty ratio corresponding to at least one of the sheet portion and the inter-sheet portion. The control unit determines whether the sensing unit is sensing the temperature of the sheet portion or the temperature of the inter-sheet portion in a rotation cycle, and controls the temperature of the heating unit by using the adjustment value stored in the storage unit corresponding to the sheet portion or the inter-sheet portion depending on a determination result.

The invention provides a control method of a fixing device including a fixing unit, having a sheet portion and an inter-sheet portion, for heating and fixing a toner image onto each of sheets by rotationally bringing the sheet portion into contact with each the sheet, and a heating unit for heating the fixing unit. The control method includes the steps of sensing a temperature of the fixing unit; controlling a temperature of the heating unit by changing a duty ratio of on/off of the heating unit based on the sensed temperature; determining whether the sensed temperature corresponds to the temperature of the sheet portion or the temperature of the inter-sheet portion in a rotation cycle; referring to a storage unit for storing an adjustment value of the duty ratio corresponding to at least one of the sheet portion and the inter-sheet portion; obtaining the adjustment value corresponding to the sheet portion or the inter-sheet portion according to the determination result, from the storage unit; and adjusting the temperature of the heating unit by using the obtained adjustment value.

An image forming apparatus according to the invention includes an image forming unit for forming a toner image on a sheet; a fixing unit having a sheet portion and an inter-sheet portion, for heating and fixing the toner image onto each of sheets by rotationally bringing the sheet portion into contact with each the sheet; a heating unit for heating the fixing unit; a sensing unit for sensing a temperature of the fixing unit; and a control unit for controlling a temperature of the heating unit by changing a duty ratio of on/off of the heating unit based on a sensing output of the sensing unit. The control unit includes a storage unit for storing an adjustment value of the duty ratio corresponding to at least one of the sheet portion and the inter-sheet portion. The control unit determines whether the sensing unit is sensing the temperature of the sheet portion or the temperature of the inter-sheet portion in a rotation cycle, and controls the temperature of the heating unit by using the adjustment value stored in the storage unit corresponding to the sheet portion or the inter-sheet portion depending on a determination result.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of a fixing device and an image forming apparatus according to the invention will be described below with reference to the drawings. In the figures, the same components bear the same reference numbers, and description thereof is not repeated.

First Embodiment

<1. Whole Structure of a Printer>

Figure 1:
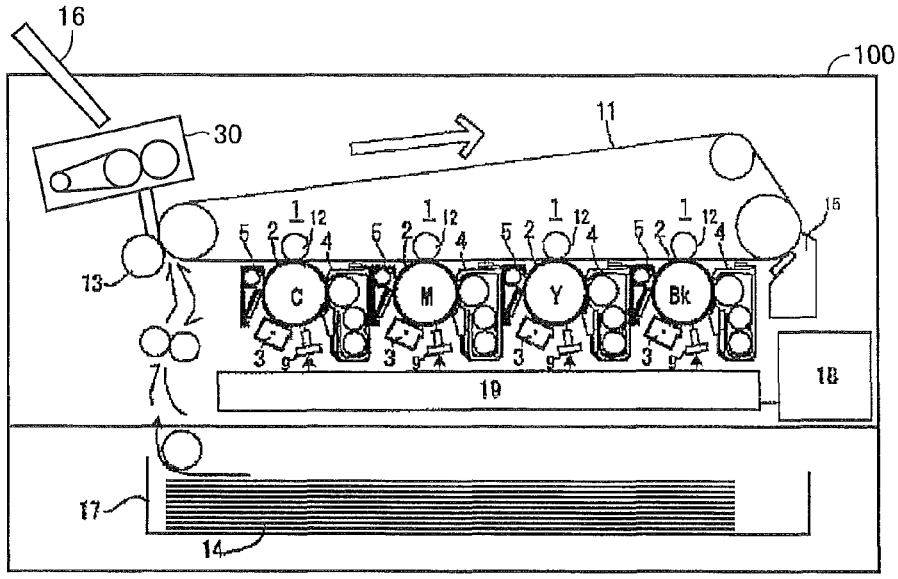
FIG. 1 schematically shows an internal structure of a printer that is an embodiment of a fixing device and an image forming apparatus of the invention.

FIG. 1 schematically shows an internal structure of a digital color printer (which will be referred to as a "printer" hereinafter) 100 of a tandem type that is a first embodiment of a fixing device and an image forming apparatus according to the invention.

Referring to FIG. 1, the printer of this embodiment is provided with four image forming units 1 that form toner images of black (Bk), yellow (Y), magenta (M) and cyan (C).

In printer 100, image forming units 1 are arranged in the order of Bk, Y, M and C along an intermediate transfer belt 11 that circulates in a direction indicated by an arrow A1.

When the toner image developed on a photosensitive drum 2 of each image forming unit 1 reaches a position where it comes into contact with intermediate transfer belt 11, the toner image is transferred onto intermediate transfer belt 11 by a primary transfer unit 12 which will be described later.

When the toner image transferred onto intermediate transfer belt 11 passes through each image forming unit 1, the color is overlaid on the toner image so that the toner image in full color is finally formed on intermediate transfer belt 11.

In a further downstream position, a so-called secondary transfer unit 13 collectively transfers the above toner image onto a record sheet 14 of paper or the like.

When record sheet 14 passes through a fixing device 30 arranged in an upper position within printer 100, the toner image is fixed and record sheet 14 is discharged onto a discharge tray 16.

Record sheets 14 are accommodated in a record sheet cassette 17 arranged in a bottom portion of printer 100. Record sheets 14 are transferred one by one to secondary transfer unit 13.

After the secondary transfer, a cleaning blade 15 removes the toner remaining on intermediate transfer belt 11 from intermediate transfer belt 11, and a transfer screw (not shown) transfers the removed tone for collecting it into a discharged toner container (not shown).

A control device 18 includes a CPU (Central Processing Unit) 501 to be described later, and controls entire printer 100.

Control device 18 provides a signal corresponding to an image to be formed to an exposure control device 19.

Exposure control device 19 drives each of exposing units 9 according to the image of corresponding color to be formed.

Image forming unit 1 includes a charging unit 3 for uniformly charging photosensitive drum 2, exposing unit 9 for performing exposure according to the image to be formed and a developing unit 4 for developing an electrostatic latent image formed by the exposure with the toner of the corresponding color.

Primary transfer unit 12 performs primary transfer to transfer the toner image developed on photosensitive drum 2 onto transfer belt 11.

After the primary transfer, the toner remaining on photosensitive drum 2 is removed by a cleaning unit 5 arranged downstream (i.e., downstream in the rotation direction of photosensitive drum 2) from corresponding primary transfer unit 12, and is collected through a lower side of cleaning unit 5.

Figure 2:
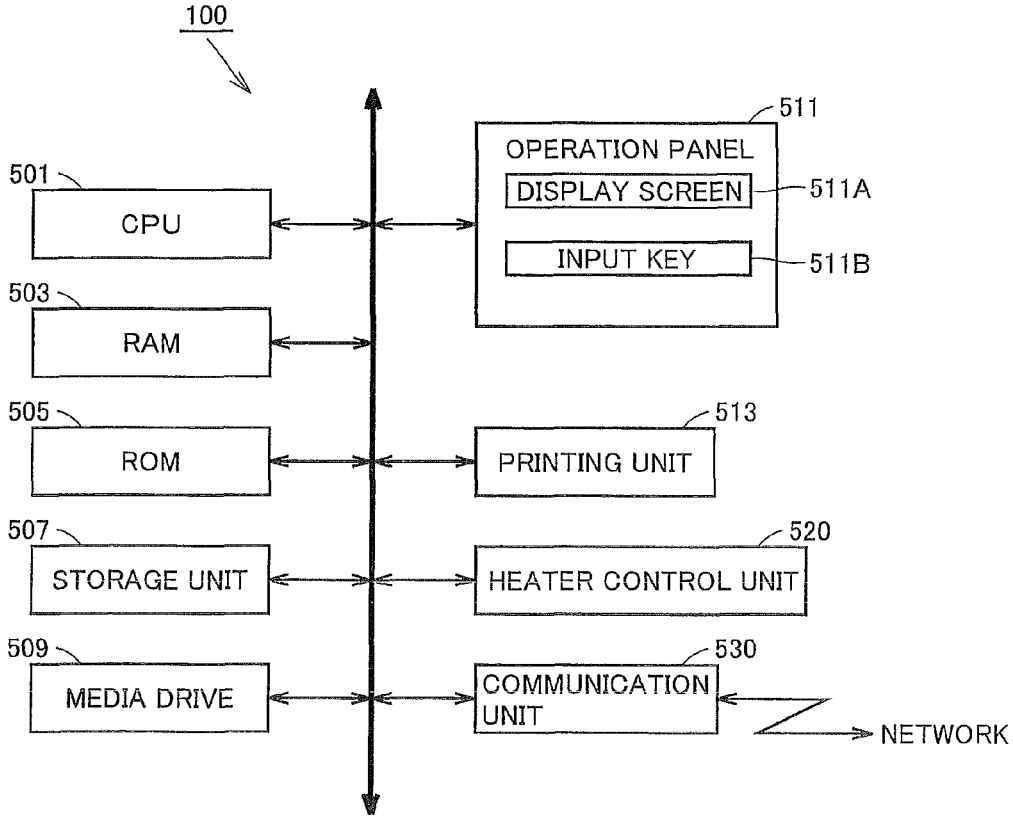
FIG. 2 shows a hardware structure of the printer in FIG. 1.

FIG. 2 shows a hardware structure of printer 100 in FIG. 1.

Referring to FIG. 2, printer 100 includes CPU 501 entirely controlling printer 100, an RAM (Random Access Memory) 503 for temporarily storing data, an ROM (Read Only Memory) 505 for storing programs and constants, a storage unit 507 for storing image data and the like, a media driver 509 for performing data reading and writing from/to a recording medium (a memory card or the like) that is removably attached to printer 100, an operation panel 511 for accepting an operation of a user, a printing unit 513 for printing the image data on the record sheet (record paper sheet), a heater control unit 520 for controlling driving of heaters arranged in fixing device 30, and a communication unit 517 for connection to a network.

Operation panel 511 is provided with a display screen 511A for displaying a state of printer 100 and command options to a user, and input keys 511B.

<2. Block Structure of a Major Portion of the Printer>

Figure 3:
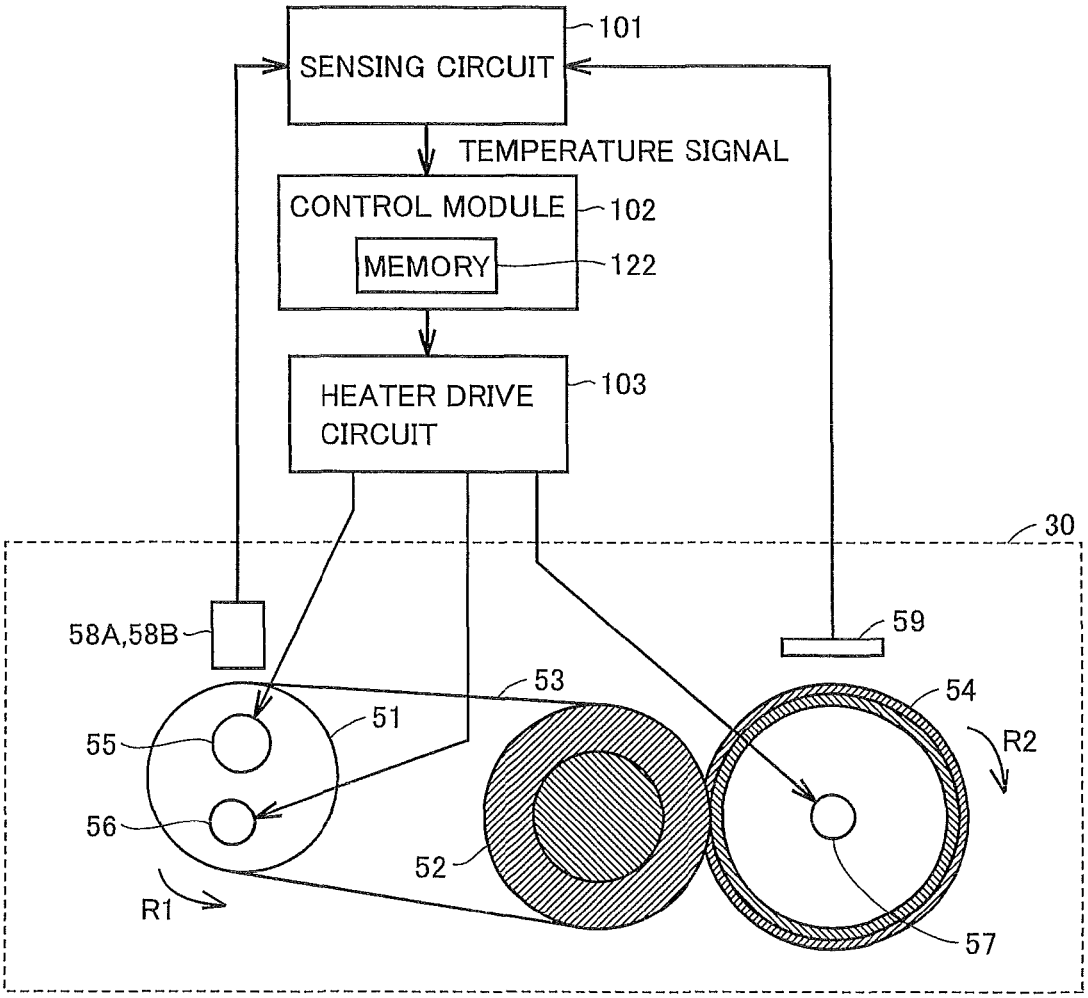
FIG. 3 schematically shows a block structure of a heater control unit in FIG. 2.

FIG. 3 schematically shows a block structure of a heater control unit as well as a schematic structure of fixing device 30.

Referring to FIG. 3, a fixing belt 53 and a pressing roller 54 in fixing device 30 nip record sheet 14 that is fed from a lower position, and rotate to feed record sheet 14 upward. In fixing device 30, contact portions of fixing belt 53 and pressing roller 54 form a nip portion nipping record sheet 14.

Fixing device 30 includes a heating roller 51 and a fixing roller 52 around which fixing belt 53 is arranged. Heating roller 51 accommodates a long heater 55 and a short heater 56. Arrows R1 and R2 indicate rotation directions of fixing belt 53 and pressing roller 54, respectively.

Pressing roller 54 contains a pressing heater 57.

In a position above heating roller 51 and outside fixing belt 53, there are arranged thermopiles 58A and 58B in contact with fixing belt 53 for sensing surface temperatures of fixing belt 53.

A pressing thermistor 59 is arranged above pressing roller 54 with a space therebetween for sensing a surface temperature of pressing roller 54.

FIG. 3 shows a block structure of heater control unit 520 relating to the temperature control of fixing device 30 in printer 100. Heater control unit 520 includes a sensing circuit 101, a control module 102 and a heater drive circuit 103.

Sensing circuit 101 receives sensing outputs of thermopiles 58A and 58B as well as a sensing output of pressing thermistor 59.

Sensing circuit 101 transmits signals relating to the temperatures sensed by thermopiles 58A and 58B as well as pressing thermistor 59 to control module 102.

Control module 102 is implemented, e.g., by CPU 501 executing programs when necessary. Control module 102 includes a memory 122 for storing the programs to be executed by CPU 501 as well as data and the like required for executing such programs.

Heater drive circuit 103 supplies the drive powers to thermopiles 58A and 58B as well as pressing heater 57. Control module 102 controls the form of driving of these heaters by heater drive circuit 103. Basically, the drive control of them is performed in a well-known manner such as proportional control based on a predetermined set temperature or PID (Proportional Integral Differential) control. Specifically, based on such control, a ratio (duty) of a power-on time of each heater is controlled. Particularly, in this embodiment, the drive control of long heater 55 or short heater 56 is performed such that the duty determined based on the above control is corrected based on the sensed temperatures of thermopiles 58A and 58B.

Figure 4:
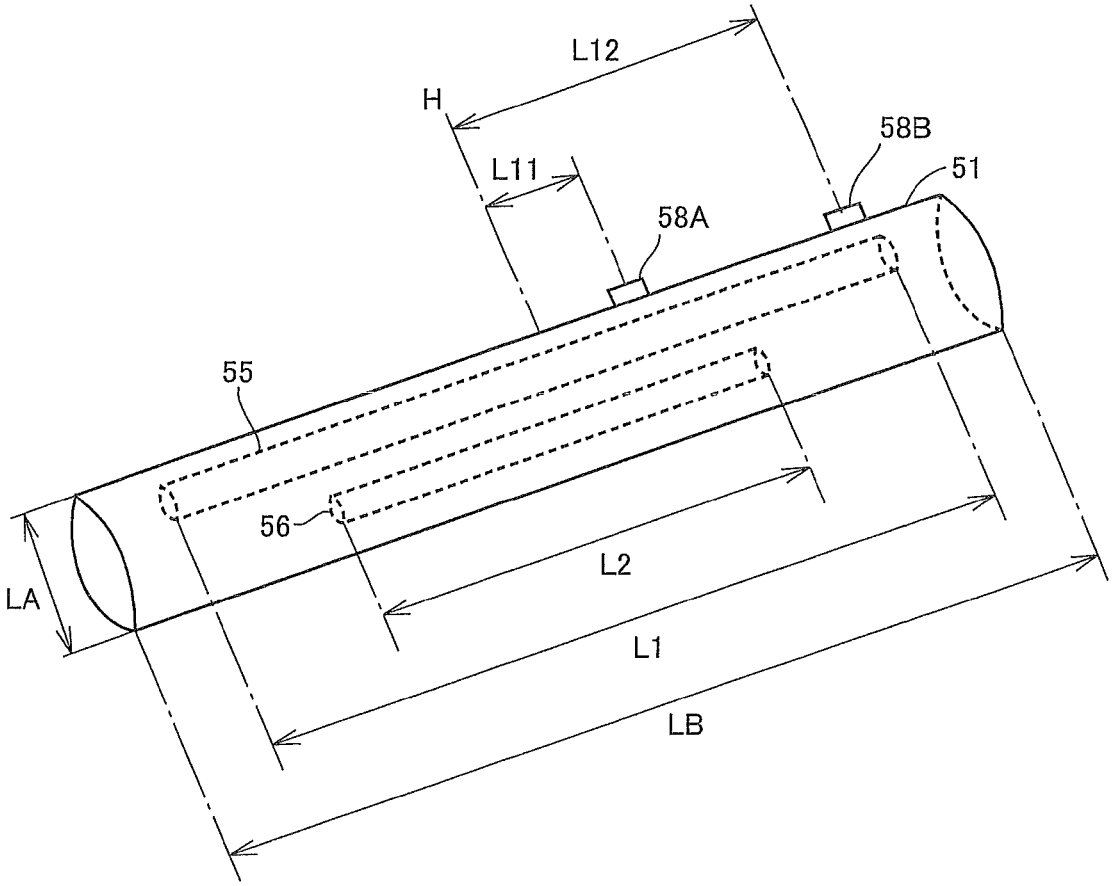
FIG. 4 is a perspective view of a heating heater in FIG. 3.

Referring to FIG. 4, specific examples of the respective components of fixing device 30 will be discussed. FIG. 4 is a perspective view of heating roller 51.

The specific examples discussed in the specification are merely examples of the structures of fixing device 30, and the structures of the fixing device of the invention is not restricted to them.

Heating roller 51 takes a form of a substantially cylindrical column having an outer diameter (i.e., a length LA in FIG. 3) of about 25 mm. Heating roller 51 has a hollow core of 0.6 mm in diameter made of aluminum, and an outer surface of the core is covered with a coating of PTFE (polytetrafluorethylene) of 15 μm in thickness.

In FIG. 3, LB indicates a longitudinal size of the nip portion of heating roller 51, i.e., a size perpendicular to a transporting direction of record sheet 14 in printer 100, and is about 330 mm.

Heating roller 51 contains long heater 55 and short heater 56, which are made of, e.g., halogen lamp heaters, respectively. A length of long heater 55 in the lengthwise direction of the nip portion, i.e., a length L1 in FIG. 3 is 290 mm, and a length of short heater 56 in the lengthwise direction of the nip portion, i.e., a length L2 in FIG. 3 is 180 mm.

Long heater 55 is the halogen lamp heater, e.g., of 999 W, and short heater 56 is the halogen lamp heater, e.g., of 790 W.

Returning to FIG. 3, fixing roller 52 takes a form of a substantially cylindrical column of 30 mm in outer diameter. Fixing roller 52 has a solid core of 22 mm in diameter that is made of iron and is coated with rubber of 4 mm in thickness, and the surface of the rubber is coated with a sponge of 2 mm in thickness.

Fixing belt 53 takes a form of a substantially cylindrical column of 60 mm in outer diameter, and has a base member of 45 μm in diameter that is made of nickel, is coated with rubber of 200 μm in thickness and is further coated with PFA (perfluoro-alkoxy alkane) of 30 μm.

Pressing heater 57 is formed of a halogen heater of 230 W having a light-emission length 290 mm in the lengthwise direction of the nip portion.

Then, an arrangement of thermopiles 58A and 58B will be described.

Referring to FIG. 4, long heater 55 and short heater 56 in heating roller 51 have centers in the lengthwise direction of the nip portion, which are aligned to each other in the direction perpendicular to the above lengthwise direction. These centers are also aligned to the center (i.e., the center in the lengthwise direction of the nip portion of the pressing roller 54) of record sheet 14 fed to the nip portion.

Pressing thermistor 59 is arranged in the position spaced in the lengthwise direction of the nip portion by 40 mm from the center of the nip portion (of which position will be referred to as a "central sheet passing reference position" hereinafter of the sake of convenience when necessary, and matches the center of passing record sheet 14).

In FIG. 4, "H" indicates positions of centers, in the above direction, of long heater 55 and short heater 56. Thermopiles 58A and 58B are spaced from center H by 40 mm and 140 mm in the lengthwise direction of the nip portion, respectively. In FIG. 4, "L11" indicates a distance in the lengthwise direction of the nip portion from center H to thermopile 58A, and "L12" indicates a distance from center H to thermopile 58B in the above lengthwise direction.

Thermopiles 58A and 58B are configured to sense the temperature of fixing belt 53 by collecting infrared rays radiated from fixing belt 53.

<3. General Temperature Control in the Fixing Device>

<3-1. Description About State>

Upon power-on, printer 100 enters a warm-up state.

When the sensed temperature in fixing device 30 attains a predetermined temperature thereafter, a ready flag is set. When a print signal has not occurred, the apparatus enters the standby state. When the print signal occurs, it enters the print state.

In printer 100, the print signal occurs when printer 100 receives a print instruction signal from another device through a communication unit 530 and/or the user enters a print instruction signal through operation panel 511.

<3-2. Operation in the Warm-Up State>

In the warm-up state, control module 102 turns on long heater 55 and pressing heater 57 for raising the temperature of the nip portion to a temperature allowing the print operation.

In this operation, control module 102 operates to rotate pressing roller 54 by a drive force transmitted to a drive gear (not shown) so that the rotation of pressing roller 54 rotates fixing belt 53 as well as fixing and heating rollers 52 and 51, and thereby the heat of heating and pressing rollers 51 and 54 is transferred to the surfaces of fixing belt 53 and pressing roller 54. In this operation, a linear velocity of fixing device 30 (i.e., a speed at which record sheet 14 passes through the nip portion) is, e.g., 90 mm/s.

The turn-on of the heaters and the rotation of the rollers raise the surface temperatures of fixing belt 53 and pressing roller 54 to the temperatures that allow the printing operation in printer 100.

Control module 102 refers to a temperature (heating corrected temperature) obtained by correcting the temperature sensed by thermopile 58A as well as a temperature (pressing corrected temperature) obtained by appropriately correcting the temperature sensed by pressing thermistor 59. When it is determined that both the above temperatures have reached the temperature allowing the print operation, the ready flag is set.

In this embodiment, the ready flag is set when the heating corrected temperature reaches 185° C., and pressing corrected temperature reaches 135° C.

(Heating Corrected Temperature)

For obtaining the heating corrected temperature, the temperature sensed by thermopile 58A is corrected as follow.

Figure 9:
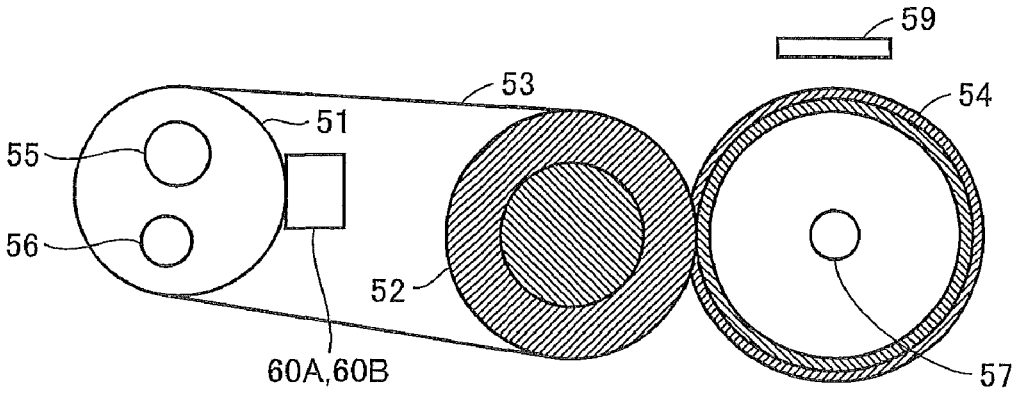
FIG.9 PRIOR ART
FIG. 9 schematically shows a structure of a conventional fixing device.

Conventionally, the temperature of heating roller 51 is sensed by heating thermistors 60A and 60B arranged in contact with heating roller 51 as shown in FIG. 9. In printer 100 of the embodiment, as shown in FIG. 3, thermopiles 58A and 58B for sensing the temperature of heating roller 51 are not arranged inside fixing belt 53, but are arranged outside fixing belt 53. In printer 100 of this embodiment, the temperatures sensed by thermopiles 58A and 58B are converted into temperatures which could be sensed by heating thermistors 60A and 60B under the same conditions, and the temperatures thus converted are used for the on/off control of long heater 55 (and/or short heater 56).

The sensed temperatures of thermopiles 58A and 58B are corrected using correlations between the temperatures sensed by heating thermistors 60A and 60B and the temperatures sensed by thermopiles 58A and 58B, and these correlations are obtained in advance, for example, by experiments that were performed in advance by operating the fixing device arranged as shown in FIG. 9 and fixing device 30 arranged as shown in FIG. 3 under the same conditions.

The above correction can provide the heating corrected temperature.

The pressing corrected temperature of pressing roller 54 can be obtained similarly to the heating side.

<3-3. Operation in the Standby State>

In the standby state, the on/off of long heater 55 and pressing heater 57 is controlled while heating and pressing rollers 51 and 54 are at rest.

The set temperature of long heater 55 is set, e.g., to 185° C. when the on/off control is performed. The set temperature of pressing heater 57 is set, e.g., to 135° C. when the on/off control is performed.

In the standby state, the on/off of both the heaters is controlled using the heating corrected temperature and the pressing corrected temperature.

<3-4. Operation in the Printing State>

<3-4-1. Temperature Control on the Pressing Side>

In the printing state, the sensed temperature of pressing thermistor 59 is corrected similarly to the standby state already described, and the on/of of pressing heater 57 is controlled. The set temperature in this on/off control is, e.g., 135° C.

<3-4-2. Temperature Control on the Heating Side>

In the printing state, one of long heater 55 or short heater 56 becomes a target of the on/off control, and the other is turned off, depending on the sheet side included in the print signal.

In the following description, the on/off control target selected from between long heater 55 and short heater 56 will be referred to as a "heating heater". In the following operation, supplying an electric power to the heater may be referred to as "turning on the heater" hereinafter.

In printer 100, when the sheet side (sheet width) in the direction perpendicular to the sheet passing direction is, e.g., 216 mm or less, short heater 56 is the on/off control target. When the size is larger than 216 mm, long heater 55 and short heater 56 are the on/off control targets.

More specifically, when a difference between the sensed temperatures of thermopiles 58B and 58A is smaller than a predetermined temperature, long heater 55 is selected as the target of the on/off control. When the difference between the sensed temperatures thereof is equal to or larger than the predetermined temperature, short heater 56 is selected as the target of the on/off control.

The on/off control first determines a duty (ratio) of the on/off time of the basic heater (long heater 55 or short heater 56) based on the environmental conditions of printer 100. The basic duty thus determined will be referred to as a "center on-ratio" hereinafter.

The center on-ratio is determined, e.g., based on a table 1.

TABLE 1

| | Speed | Elapsed time after reaching predetermined warm-up temperature (s) | | | |
|---|---|---|---|---|---|
| Environment | [mm/s] | t1 | t2 | t3 | t4 |
| Low temp. | 150 | 75% | 65% | 60% | 55% |
| | 100 | 65% | 60% | 50% | 45% |
| | 50 | 55% | 60% | 45% | 40% |
| | 0 | 15% | 15% | 15% | 15% |
| Normal | 150 | 75% | 65% | 55% | 50% |
| | 100 | 65% | 50% | 35% | 30% |
| | 50 | 55% | 45% | 40% | 35% |
| | 0 | 15% | 15% | 15% | 15% |
| High temp. | 150 | 75% | 65% | 55% | 50% |
| | 100 | 65% | 50% | 35% | 30% |
| | 50 | 55% | 45% | 40% | 35% |
| | 0 | 15% | 15% | 15% | 15% |

In the table 1, an environmental temperature, a (sheet passing) speed and an elapsed time are described as the environmental conditions of printer 100. The respective on-ratios determined based on them are represented in units of %.

The environmental temperature is a temperature sensed by a temperature sensor arranged inside printer 100. In the table 1, the environmental temperature is represented as three predetermined temperature regions of "low temperature", "middle temperature" and "high temperature". The speed (sheet passing speed) is a speed at which record sheet 14 is transported in printer 100 for printing, and is specified by the latest print signal. The elapsed time is a time that elapsed after the warm-up operation achieved a predetermined temperature.

For example, in the state where the environmental temperature is "low" and the sheet passing speed is 150 mm/s, the center on-ratio is kept at 75% before the elapsed time since the warm-up operation achieved the predetermined temperature exceeds t1, is kept at 65% between elapsed times t1 and t2, is kept at 60% between elapsed times t2 and t3, and is kept at 55% between elapsed times t3 and t4.

(Correction of Center On-Ratio)

In printer 100, the center on-ratio thus determined is corrected based on the sensed temperature of thermopile 58 (thermopile 58A or 58B).

The correction of the center on-ratio will now be described below,

First, it is determined whether the portion of fixing belt 53 that is the current sensing target of thermopile 58 is a "sheet portion" or an "inter-sheet portion".

The "sheet portion" is a portion that came into contact with record sheet 14 when it was located in the nip portion. Immediately after the contact with record sheet 14, this portion is sent by the rotation of fixing belt 53 to a position opposed to thermopile 58, and becomes the target of the temperature sensing by thermopile 58.

The "inter-sheet portion" is a portion that was not in contact with record sheet 14 when it was located in the nip portion. This portion in the above state is passed through the nip portion by the rotation of fixing belt 53, and then is sent to the position opposed to thermopile 58 so that it becomes the target of the temperature sensing by thermopile 58.

Whether the portion opposed to thermopile 58 of fixing belt 53 is the "sheet portion" or the "inter-sheet portion" is determined based on whether the portion in the position opposed to thermopile 58 was in contact with record sheet 14 or not when it was located in the nip portion immediately before such determination.

In printer 100, whether the target is the sheet portion or the inter-sheet portion can be determined based on the timing according to which a sheet sensor (not shown) sensed the passing of record sheet 14, the rotation speed of pressing roller 54 and the rotation speed of the roller transporting the record sheet from sheet sensor to the nip portion.

An average of the sensed temperatures of thermopile 58 is calculated over a predetermined time.

The sensed temperatures that are obtained over the predetermined time at intervals of a constant time are stored in memory 122, and an average thereof is calculated for obtaining the above average.

The above predetermined time for the sheet portion can be the time required for moving a position on fixing belt 53 opposed to thermopile 58 from a leading portion of the sheet portion to the end thereof according to the rotation of pressing roller 54 (i.e., the time required for passing a portion of fixing belt 53 corresponding to one paper sheet of record sheet 14 through the target position of the temperature sensing by thermopile 58A or 58B).

The above predetermined time for the inter-sheet portion can also be, e.g., a predetermined time, which can be substantially equal to a predetermined time determined in connection with the sheet portion.

Then, determination is performed to specify which one of the plurality of the temperature regions for the center on-ratio correction accommodates the average of the sensed temperatures of thermopile 58. This determination is performed based on, e.g., the following table 2.

TABLE 2

| Temp. region | Sensed temp. T |
|---|---|
| 0 | set temp. +10° C. ≦ T |
| 1 | set temp. +6° C. ≦ T < set temp. +10° C. |
| 2 | set temp. +2° C. ≦ T < set temp. +6° C. |
| 3 | set temp. −2° C. ≦ T < set temp. +2° C. |
| 4 | set temp. −6° C. ≦ T < set temp. −2° C. |
| 5 | set temp. −10° C. ≦ T < set temp. −6° C. |
| 6 | T < set temp. −10° C. |

In the table 2, the average of the sensed temperatures of thermopile 58 is represented as a sensed temperature T. When the sensed temperature exceeds the set temperature, at this point in time, of fixing belt 53 by 10° C. or more, the temperature region accommodating T is "0".

When T exceeds the above set temperature by a value that is equal to or larger than 6° C. and is smaller than 10° C., the temperature region accommodating T is "1".

When T exceeds the set temperature by a value that is equal to or larger than 2° C. and is smaller than 6° C., the temperature region accommodating T is "2".

When T is equal to or higher than a temperature lower than the set temperature by 2° C. (i.e., (set temperature)−(2° C.)), and is lower than a temperature higher than the set temperature by 2° C. (i.e., (set temperature)+(2° C.)), the temperature region accommodating T is "3".

When T is equal to or higher than a temperature lower than the set temperature by 6° C. (i.e., (set temperature)−(6° C.)), and is lower than a temperature lower than the set temperature by 2° C. (i.e., (set temperature)−(2° C.)), the temperature region accommodating T is "4".

When T is equal to or higher than a temperature lower than the set temperature by 10° C. (i.e., (set temperature)−(10° C.)), and is lower than a temperature lower than the set temperature by 6° C. (i.e., (set temperature)+(6° C.)), the temperature region accommodating T is "5".

When T is lower the set temperature by 10° C. or more, the temperature region accommodating T is "6".

The on-ratio adjustment value that is the adjustment value with respect to the center on-ratio is obtained based on the newest sensed temperature of thermopile 58. This value is obtained based on the following tables 3 and 4.

TABLE 3

| | On-ratio adjustment value (1st adjustment value) | |
|---|---|---|
| Temp. region | Temp. lowering situation | Temp. rising situation |
| 0 | −15% | −17.50% |
| 1 | −10% | −12.50% |
| 2 | −5% | −7.50% |
| 3 | 0% | −2.50% |
| 4 | +5% | +2.50% |
| 5 | +10% | +7.50% |
| 6 | +15% | +12.50% |

TABLE 4

| | On-ratio adjustment value (2nd adjustment value) | |
|---|---|---|
| Temp. region | Temp. lowering situation | Temp. rising situation |
| 0 | −5% | −7.50% |
| 1 | −5% | −7.50% |
| 2 | 0% | −5.00% |
| 3 | 0% | 0% |
| 4 | 0% | 0% |
| 5 | +5% | +5.00% |
| 6 | +5% | +7.50% |

The tables 3 and 4 store the adjustment value for the center on-ratio, and correlate them with the temperature regions of the sensed temperatures of thermopile 58.

The on-ratio adjustment value (first adjustment value) shown in the table 3 is correlated with the temperature region, which is determined based on the sensed temperature at one point of thermopile 58. The temperature region based on the sensed temperature at the one point can be determined in the manner similar to that for the temperature region based on the average already described with reference to the table 2.

The on-ratio adjustment value (second adjustment value) shown in the table 4 is correlated with the temperature region, which is determined based on the average of the sensed temperatures of thermopile 58 obtained over the predetermined time as described before.

The first and second adjustment values in the tables 3 and 4 relate to the sheet portion. For example, memory 122 stores these values. In printer 100, memory 122 stores the first and second adjustment values that correspond to the temperature regions and relate to the inter-sheet portion.

The first and second adjustment values for the inter-sheet portion has such a tendency that these are bear the same sign (positive/negative sign) as the respective adjustment values in the same temperature region for the sheet portion, but are smaller in absolute value than them.

The "temp. lowering situation" and the "temp. rising situation" in the tables 3 and 4 correspond to time differential of the sensed temperature at the above one point with respect to the last sensed temperature, or time differential of the sensed temperature from which the average is calculated. When this time differential is negative, the adjustment values for the temperature lowering situation in the tables 3 and 4 are employed. When the time differential is positive, the adjustment values for the temperature rising in the tables 3 and 4 are employed.

As described above, different adjustment values are employed for the temperature lowering situation and the temperature rising situation, respectively, so that the ripple in temperature can be suppressed.

Printer 100 according to the embodiment obtains the first and second adjustment values according to the tables 3 and 4, respectively, when the sheet portion is the target of the temperature sensing by thermopile 58. When the inter-sheet portion is the target of the temperature sensing by thermopile 58, printer 100 obtains the temperature region corresponding to the sensed temperature, and obtains the first and second adjustment values corresponding to the temperature region based on stored tables other than the tables 3 and 4.

Then, printer 100 corrects the center on-ratio obtained from the table 1 according to the following equation (1), and thereby obtains an on-ratio R to be used finally for the on/off control of the heating heater.

$$\text{On-ratio } R = (\text{center on-ratio}) + (\text{first adjustment value}) + (\text{second adjustment value}) \quad (1)$$

(Effect by Correction of Center On-Ratio in the Embodiment)

The correction of the center on-ratio in the embodiment already described can control the electric power supplied to the heating heater based on the temperature of fixing roller 52 obtained by thermopile 58. Thereby, the temperature control of fixing roller 52 can cope with a power situation of the power source supplying the electric power to printer 100 as well as unexpectable situations (e.g., in which the temperature of record sheet 14 passing through the nip portion is high or low).

In this embodiment, different types of sensed temperatures are used for calculating on-ratio R depending on whether the target of the temperature sensing for fixing roller 52 is the sheet portion or the inter-sheet portion. Thereby, even when record sheet 14 passing through the nip portion is extremely cold or extremely hot, and thereby the temperature of fixing roller 52 locally changes to a large extent, such a situation can be avoided that excessive response such as rapid changes or the like occurs in quantity of the electric power supplied to the heating heater, and thereby the accuracy of the heating heater temperature control lowers.

In this embodiment, as already described with reference to the tables 3 and 4, different values can be obtained as each of the first and second adjustment values for the sensed temperature of thermopile 58 in the temperature lowering situation and the temperature rising situation, respectively. There is a tendency that the adjustment value in the temperature rising situation is larger in absolute value than that in the temperature falling situation.

Figure 6:
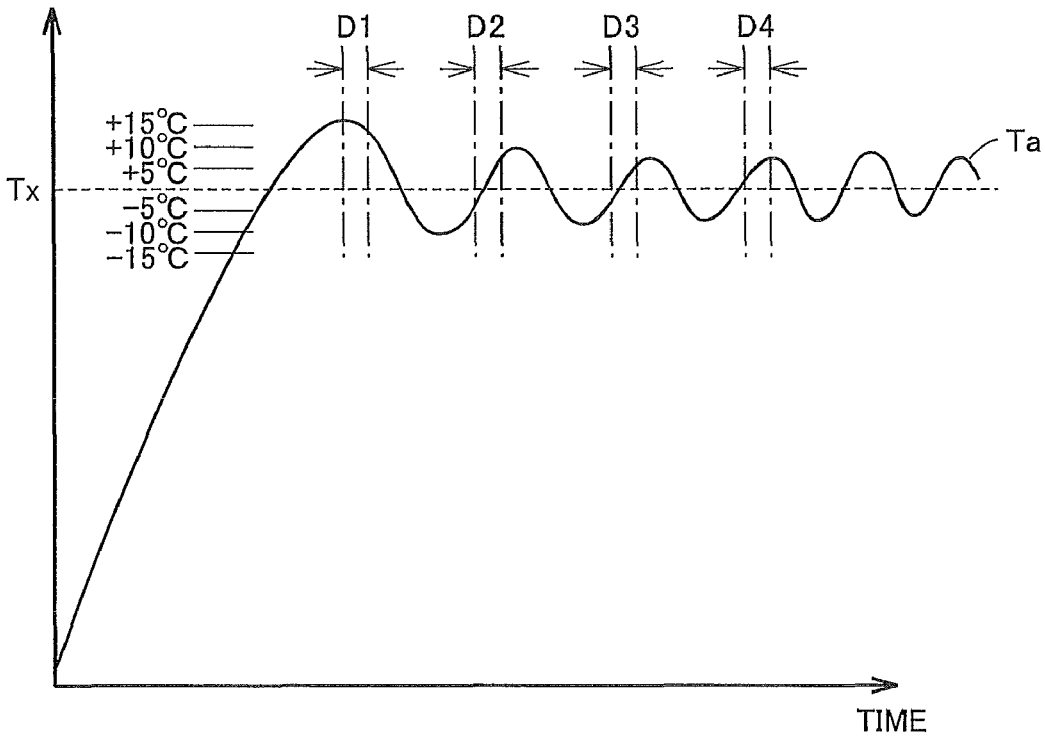
FIG. 6 illustrates a form of temperature control of a fixing belt in FIG. 3.

Referring to FIG. 6, when the sensed temperature of thermopile 58 changes, e.g., as indicated by a curve Ta and the sensed values in the respective ranges of sections D1, D2, D3 and D4 are used for calculating sensed temperature T, the adjustment value in the "Temp. lowering situation" in the table 4 is employed for section D1 in which the time differential of the sensed temperature in this section is negative. The adjustment value in the "Temp. rising situation" is employed for sections D2, D3 and D4 in which the time differentials of the sensed temperatures in these sections are positive.

(Flowchart of Correction Processing of Center On-Ratio)

A flowchart will now be discussed in connection with the processing (on-ratio correction processing) for obtaining on-ratio R by the correction of the center on-ratio in printer.

Figure 5:
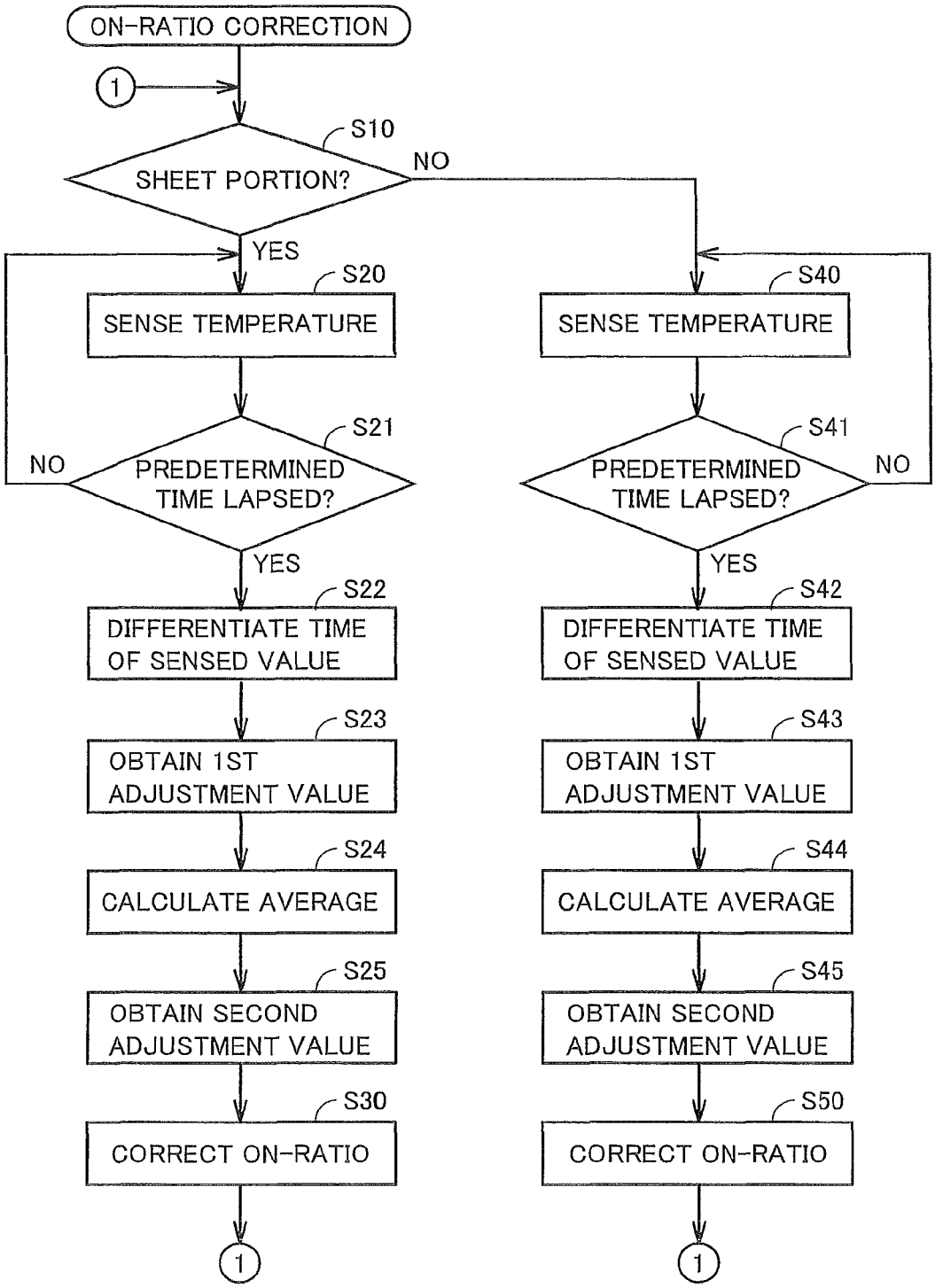
FIG. 5 is a flowchart of an on-ratio correction processing executed in the printer in FIG. 1.

FIG. 5 is a flowchart of an on-ratio correction processing executed by control module 102.

In the on-ratio correction processing shown in FIG. 5, control module 102 first determines in a step S10 whether the portion of fixing belt 53 that is currently the sensing target of thermopile 58 is the sheet portion or not. When it is the sheet portion, the process proceeds to a step S20. Otherwise, i.e., when it is the inter-sheet portion, the process proceeds to a step S40.

In step S20, control module 102 successively stores and accumulates a plurality of temperatures sensed by thermopile 58 in memory 122, and performs next processing in a step S21.

In step S21, it is determined whether the predetermined time already described has elapsed or not. When it has not elapsed, the process returns to step S20. Otherwise, the process proceeds to a step S22.

In step S22, control module 102 calculates the time differential of the sensed temperature, and the process proceeds to a step S23. Thus, control module 102 determines whether the temperature to be sensed is rising or lowering.

In step S23, control module 102 determines the first temperature region with reference to the table 2 stored in memory 122 based on the last sensed temperature of thermopile 58. Further, control module 102 refers to the table 3 stored in memory 122, and obtains the first adjustment value from the determined first temperature region and the information about rising/falling of the temperature based on the time differential of the sensed temperature calculated in step S22. Then, the process proceeds to a step S24.

In step S24, sensed temperature T is obtained by calculating the average of the plurality of sensed temperatures of thermopile 58 stored in memory 122 in step S20, and the process proceeds to a step S25.

In step S25, the second temperature region is determined from the average calculated in step S24 with reference to the table 2 stored in memory 122. Further, control module 102 obtains the second adjustment value from the second temperature region that is determined with reference to the table 4 stored in memory 122 as well as the time differential of the sensed temperature calculated in step S22. Then, the process proceeds to a step S30.

In step S30, control module 102 corrects the center on-ratio according to the equation (1), using the first adjustment value obtained in step S23 and the second adjustment value obtains in step S25, and thereby obtains on-ratio R. Then, the process returns to step S10.

In step S40, control module 102 successively stores and accumulates the plurality of temperatures sensed by thermopile 58, and the process proceeds to a step S41.

In step S41, it is determined whether the above predetermined time has elapsed or not. When it has not elapsed, the processing returns to step S40. Otherwise, the process proceeds to a step S42.

In next step S42, control module 102 calculates the time differential of the sensed temperature, and the process proceeds to a step S43. Thus, control module 102 determines whether the temperature to be sensed is rising or lowering.

In step S43, control module 102 determines the first temperature region with reference to the table 2 stored in memory 122, based on the last sensed temperature of thermopile 58. Further, control module 102 obtains the first adjustment value from the determined first temperature region and the information about the rising/lowering of the temperature obtained from the time differential of the sensed temperature calculated in step S42, with reference to the table that is stored in memory 122 independently of the table 3 described above. Then, the process proceeds to a step S44.

In step S44, sensed temperature T is obtained by calculating the average of the plurality of sensed temperatures of thermopile 58 stored in memory 122 in step S40. Then, the process proceeds to a step S45.

In step S45, the second temperature region is determined from the average calculated in step S44 with reference to the table 2 stored in memory 122. Further, control module 102 obtains the second adjustment value from the determined second temperature region and the time differential of the sensed temperature calculated in step S42, with reference to the table that is stored in memory 122 independently of the table 4 described above. Then, the process proceeds to a step S50.

In step S50, control module 102 obtains on-ratio R by correcting the center on-ratio according to the equation (1), using the first and second adjustment values obtained in steps S43 and S45, respectively, and returns the processing to step S10.

In the drive control of the heating heater according to the embodiment described above, the basic on-ration (center on-ratio) for the heater drive determined corresponding the set temperature and others is corrected based on the sensed temperature of fixing belt 53. In the correction processing, it is determined whether the temperature sensing target portion of fixing belt 53 is the sheet portion, i.e., the portion that was in contact with record sheet 14 located in the nip portion immediately before the temperature sensing, or the inter-sheet portion, i.e., the portion other than the sheet portion. The center on-ratio is corrected using the adjustment value corresponding to the specific portion thus determined, and on-ratio R is obtained.

Second Embodiment

Printer 100 of a second embodiment differs from that of the first embodiment only in details of the on-ratio correction processing. The hardware structure of printer 100 is substantially the same as that of the first embodiment, and therefore description thereof is not repeated.

Figure 7:
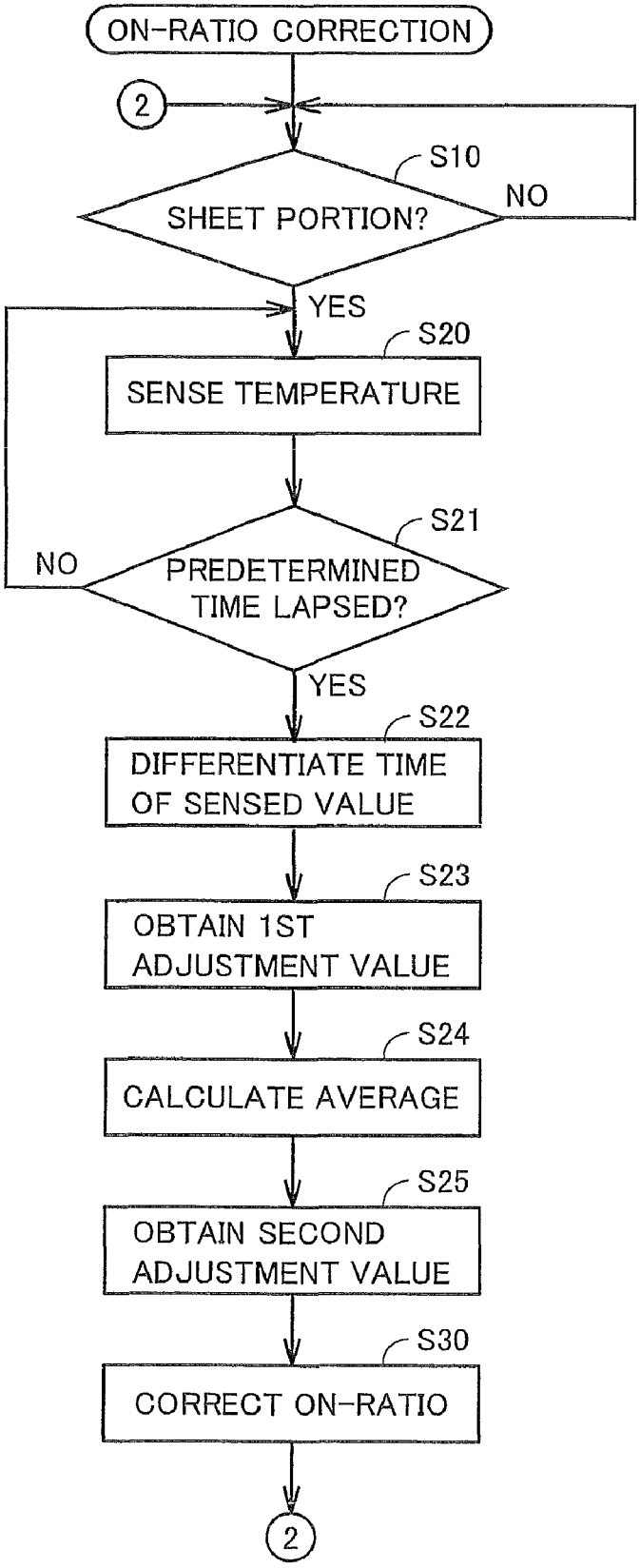
FIG. 7 is a flowchart of a modification of the on-ratio correction processing in FIG. 3.

FIG. 7 is a flowchart illustrating the on-ratio correction processing executed by control module 102 according to the embodiment.

Referring to FIG. 7, in step S10 of the on-ratio correction processing of the second embodiment, control module 102 determines whether the portion of fixing belt 53 of which temperature is to be sensed by thermopile 58 is the sheet portion or not. When it is the sheet portion, the process proceeds to steps S20-S25 and S30, similarly to the first embodiment.

When it is determined in step S10 that the target portion is not the sheet portion, (i.e., it is the inter-sheet portion), the processing in step S10 continues until it is determined that the temperature sensing target is the sheet portion.

In this embodiment, the center on-ratio is corrected according to the foregoing equation (1), using the first and second adjustment values, only when the temperature sensing target of thermopile 58 is the sheet portion.

Third Embodiment

Printer 100 of a third embodiment differs from the first embodiment only details of the on-ratio correction processing. The hardware structure of printer 100 is substantially the same as that of the first embodiment, and therefore description thereof is not repeated.

Figure 8:
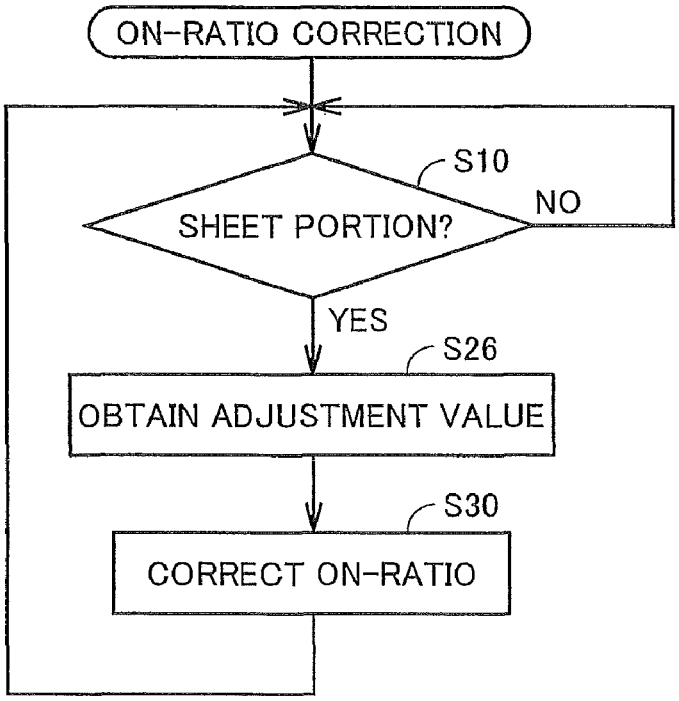
FIG. 8 is a flowchart of another modification of the on-ratio correction processing in FIG. 3.

FIG. 8 is a flowchart illustrating the on-ratio correction processing executed by control module 102 of the third embodiment.

Referring to FIG. 8, in step S10 of the on-ratio correction processing, control module 102 determines whether the portion of fixing belt 53 of which temperature is to be sensed by thermopile 58 is the sheet portion or not. When it is the sheet portion, the process proceeds to a step S26.

In step S26, control module 102 obtains the adjustment value for the center on-ratio, based on the sensed temperature of thermopile 58, and the process proceeds to step S30.

For example, a table 5 is used for obtaining the adjustment value in step S26.

TABLE 5

| Temp. region | On-ratio adjustment value |
|---|---|
| 0 | −15% |
| 1 | −10% |
| 2 | −5% |
| 3 | 0% |
| 4 | +5% |
| 5 | +10% |
| 6 | +15% |

In the table 5, the adjustment value for the on-ratio obtained based on the table 2 correlates to only the temperature region accommodating the sensed temperature.

In step S26, control module 102 may obtain the adjustment value by obtaining the temperature region based on the sensed temperature at one point, and then obtaining the adjustment value corresponding to the temperature region thus obtained, or by calculating the average of the sensed temperatures sensed over a predetermined period, and then obtaining the adjustment value corresponding to the temperature region accommodating the average, as already described in connection with steps S20, S21 and S23-S25.

In step S26, control module 102 obtains from the table 5 the adjustment value corresponding to the temperature region accommodating the sensed temperature or the average thereof.

In step S30, control module 102 obtains a sum of the adjustment value obtained in step S26 and the center on-ratio obtained based on the table 1, and thereby corrects the center on-ratio to calculate on-ratio R. Then, the process proceeds to step S10.

Fourth Embodiment

The on-ratio correction processing of the first embodiment already described with reference to FIG. 5 calculates the average of the sensed temperatures of thermopile 58 over the predetermined time, and further calculates the time differential of the sensed temperature from which the average is calculated. Then, it determines whether the adjustment value for the temperature lowering is to be obtained or that for the temperature rising is to be obtained, based on whether the time differential is negative or positive.

The on-ratio correction processing of the fourth embodiment uses a table 6 instead of the table 3 for obtaining the first adjustment value.

TABLE 6

| Temp. region | On-ratio adjustment value (1st adjustment value) |
|---|---|
| 0 | −15% |
| 1 | −10% |
| 2 | −5% |
| 3 | 0% |
| 4 | +5% |
| 5 | +10% |
| 6 | +15% |

Also, a table 7 is used instead of the table 4 for obtaining the second adjustment value.

TABLE 7

| Temp. region | On-ratio adjustment value (2nd adjustment value) |
|---|---|
| 0 | −5% |
| 1 | −5% |
| 2 | 0% |
| 3 | 0% |
| 4 | 0% |
| 5 | +5% |
| 6 | +5% |

The tables 6 and 7 describe the first and second adjustment values without a distinction between the temperature lowering situation and the temperature rising situation.

Thus, the first and second adjustment values may be obtained without obtaining the time differential already described.

Other Modifications

In each of the embodiments already described, the center on-ratio is obtained according to the table 1. Thus, the center on-ratio is set according to the environmental conditions, and particularly the environmental temperature, the sheet passing speed, the number of passed sheets and the warm-up time.

The environmental conditions handled as the factors determining the center on-ratio may include an internal humidity of printer 100 and a kind of record sheet 14 specified by the print signal.

The kind of record sheet 14 is specified, e.g., by a thickness of record sheet 14 and a quality of the material of the sheet such as normal paper, quality paper or an OHP (overhead projector) sheet.

In each of the embodiments in the specification, the fixing unit of printer 100 includes fixing belt 53 and fixing roller 52 that receives the rotational drive force from of pressing roller 54 to rotate fixing belt 53. Thus, in printer 100 of each embodiment, the endless belt fixes the toner image on record sheet 14. In this structure, the size of the belt in the rotating direction is larger than the size of record sheet 14 in the transporting direction in many cases. Thus, it can be considered that the temperature of the belt is liable to lower locally due to contact with record sheet 14. In each embodiment, the temperature of the belt is sensed, the drive control is conducted on the portion (long heater 55 and/or short heater 56) heating the belt, and it is determined for distinction whether the sensed temperature was sent from the portion of the above lowered temperature, or another portion. Therefore, it can be considered that the above control is particularly suitable for the printer provided with the fixing unit that uses the belt of the above structure.

In each of the embodiments, the adjustment value described with reference to the tables 3 to 7 is stored corresponding to the temperature region. Thus, in each embodiment, the adjustment value corresponding to the temperature region is obtained after the temperature region related to the sensed temperature is obtained.

In each of the embodiments already described, the average of the sensed temperatures determines the second adjustment value. However, the average of the temperature regions may determine the second adjustment value. For example, such a manner may be employed that obtains the average from the numbers assigned to the corresponding temperature regions.

Each of the temperature regions that are set as shown in the table 2 may not be fixed, and may be variable. For example, only temperature regions 4, 5 and 6 may be adjustable to reduce the respective widths. Also, the temperature regions thereof may be variable depending on the situations in which the lowering of the temperature is not desired, and vice versa.

In printer 100, it is not necessary to store and obtain the adjustment values classified under the temperature regions, provided that the adjustment value can be selected according to the sensed temperature. When the adjustment value is classified under the temperature regions for storing and obtaining, as is done in the embodiment, this further facilitates the processing of controlling the heater drive.

According to the invention, the fixing device and the image forming apparatus sense the temperature of the fixing unit, and can control the duty of on/off of the fixing unit based on the sensed temperature. Also, the fixing device and the image forming apparatus determine the adjustment value of the duty based on whether the temperature sensing target portion of the fixing unit is the sheet portion of which temperature is locally lowered due to a contact of the fixing unit with the sheet, or the inter-sheet portion other than the above sheet portion. Thus, the heat control uses the sensed temperatures, making a distinction between them depending on whether the sensed temperature was obtained from the above portion or not.

Thereby, the heating control of the fixing unit can correspond to the temperature of the fixing unit. Therefore, the temperature control of the fixing unit can correspond even to the electric power situation and an unpresumable attribute of the paper sheet, which can improve the accuracy of the temperature control.

The sensed temperature changes largely depending on whether the temperature sensing target portion is the foregoing portion or not. Therefore, if the sensed temperature of the foregoing portion and the sensed temperature of a portion other than the foregoing portion were handled equally to each other in the heating control, the heating control would follow the changes in sensed temperature, and the control form might change excessively. According to the invention, the sensed temperature is handled in different manners depending on whether the sensing target is the foregoing portion or not. Therefore, such a situation can be avoided that the heating form of the heating unit changes excessively. Therefore, the accuracy of the temperature control of the fixing unit can be improved.

As described above, the invention can improve the accuracy of the temperature control of the fixing unit, and thereby can improve the accuracy of the temperature control of the nip portion so that the image fixing performance can be stable.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fixing device comprising:

a fixing unit, having a sheet portion and an inter-sheet portion, for heating and fixing a toner image onto each of sheets by rotationally bringing said sheet portion into contact with each said sheet;

a heating unit for heating said fixing unit;

a sensing unit for sensing a temperature of said fixing unit; and a control unit for controlling a temperature of said heating unit by changing a duty ratio of on/off of said heating unit based on a sensing output of said sensing unit, wherein said control unit includes a storage unit for storing an adjustment value of said duty ratio corresponding to at least one of said sheet portion and said inter-sheet portion, and said control unit i) determines whether said sensing unit is sensing the temperature of said sheet portion or the temperature of said inter-sheet portion in a rotation cycle, and ii) controls the temperature of said heating unit by using said adjustment value stored in said storage unit corresponding to said sheet portion or said inter-sheet portion depending on a determination result.

2. The fixing device according to claim 1, wherein said storage unit stores a basic value of said duty corresponding to the sensed temperature of said sheet portion, and when said control unit determines that said sensing unit is sensing the temperature of said sheet portion, said control unit controls said heating unit by correcting said basic value with said adjustment value based on an average of the sensed temperatures of said sheet portion provided by said sensing unit.

3. The fixing device according to claim 2, wherein said adjustment value includes:

a first adjustment value corresponding to a last-sensed temperature among sensed temperatures sensed by said sensing unit over a predetermined period, and a second adjustment value corresponding to an average of the sensed temperatures sensed over said predetermined period; and said storage unit stores said first and second adjustment values.

4. The fixing device according to claim 1, wherein said storage unit stores a plurality of said adjustment values correlated to a plurality of temperature regions, respectively, and said control unit further determines which one of said plurality of temperature regions corresponds to the state at each point in time, based on the sensed temperature and controls temperature of said heating unit by using said adjustment value stored in said storage unit corresponding to the determined temperature region.

5. The fixing device according to claim 1, wherein said storage unit stores a table defining the adjustment value corresponding to said sheet portion, and said control unit determines said adjustment value corresponding to the sensed temperature with reference to said table.

6. The fixing device according to claim 1, wherein said control unit further determines whether the sensed temperature is the temperature in a temperature rising situation or the temperature in a temperature falling situation, said storage unit stores said adjustment value corresponding to the temperature rising situation, and stores said adjustment value corresponding to the temperature lowering situation and being independent of said adjustment value corresponding to the temperature rising situation, and said control unit obtains said adjustment value corresponding to a result of the determination by said time differential unit.

7. The fixing device according to claim 6, wherein the adjustment value corresponding to said temperature rising situation is larger in absolute value than the adjustment value corresponding to said temperature lowering situation.

8. The fixing device according to claim 1, wherein said fixing unit includes an endless belt member, and a fixing roller rotating said belt member, and said heating unit heats said belt member.

9. A control method of a fixing device including a fixing unit, having a sheet portion and an inter-sheet portion, for heating and fixing a toner image onto each of sheets by rotationally bringing said sheet portion into contact with each said sheet, and a heating unit for heating said fixing unit, comprising the steps of:

sensing a temperature of said fixing unit;

controlling a temperature of said heating unit by changing a duty ratio of on/off of said heating unit based on the sensed temperature;

determining whether the sensed temperature corresponds to the temperature of said sheet portion or the temperature of said inter-sheet portion in a rotation cycle;

referring to a storage unit for storing an adjustment value of said duty ratio corresponding to at least one of said sheet portion and said inter-sheet portion;

obtaining said adjustment value corresponding to said sheet portion or said inter-sheet portion according to the determination result, from said storage unit; and adjusting the temperature of said heating unit by using the obtained adjustment value.

10. The control method of the fixing device according to claim 9, wherein when the sensed temperature corresponds to the temperature of said sheet portion, a basic value of said duty ratio stored corresponding to the sensed temperature of said sheet portion is corrected with said adjustment value based on an average of the sensed temperatures of said sheet portion, and thereby said heating unit is controlled.

11. The control method of the fixing device according to claim 10, wherein said adjustment value includes a first adjustment value corresponding to a last-sensed temperature among sensed temperatures sensed over a predetermined period, and a second adjustment value corresponding to an average of the sensed temperatures sensed over said predetermined period, and said basic value is corrected using said first and second adjustment values.

12. The control method of the fixing device according to claim 9, further comprising:

a step of storing a plurality of said adjustment values correlated to a plurality of temperature regions, respectively, and a step of determining which one of said plurality of temperature regions corresponds to the state at each point in time, based on the sensed temperature, and a step of controlling temperature of said heating unit by using said adjustment value corresponding to the determined temperature region.

13. The control method of the fixing device according to claim 9, wherein said storage unit stores a table defining the adjustment value corresponding to said sheet portion, and said step of determining said adjustment value includes a step of determining said adjustment value corresponding, in said table, to the sensed temperature sensed when said step determines as said sheet portion.

14. The control method of the fixing device according to claim 9, further comprising:

a step of determining whether a situation is a temperature rising situation or a temperature falling situation, by differentiating the sensed temperature of said fixing unit with respect to a time, wherein said storage unit stores said adjustment value corresponding to the temperature rising situation, and stores said adjustment value corresponding to the temperature lowering situation and being independent of said adjustment value corresponding to the temperature rising situation, and said step of determining said adjustment value includes a step of determining said adjustment value corresponding to a result of the determination about the temperature rising situation and the temperature lowering situation.

15. An image forming apparatus comprising:

an image forming unit for forming a toner image on a sheet;

a fixing unit having a sheet portion and an inter-sheet portion, for heating and fixing the toner image onto each of sheets by rotationally bringing said sheet portion into contact with each said sheet;

a heating unit for heating said fixing unit;

a sensing unit for sensing a temperature of said fixing unit; and a control unit for controlling a temperature of said heating unit by changing a duty ratio of on/off of said heating unit based on a sensing output of said sensing unit, wherein said control unit includes a storage unit for storing an adjustment value of said duty ratio corresponding to at least one of said sheet portion and said inter-sheet portion, and said control unit i) determines whether said sensing unit is sensing the temperature of said sheet portion or the temperature of said inter-sheet portion in a rotation cycle, and ii) controls the temperature of said heating unit by using said adjustment value stored in said storage unit corresponding to said sheet portion or said inter-sheet portion depending on a determination result.

16. The image forming apparatus device according to claim 15, wherein said storage unit stores a basic value of said duty corresponding to the sensed temperature of said sheet portion, and when said control unit determines that said sensing unit is sensing the temperature of said sheet portion, said control unit controls said heating unit by correcting said basic value with said adjustment value based on an average of the sensed temperatures of said sheet portion provided by said sensing unit.

17. The fixing device according to claim 16, wherein said adjustment value includes:

a first adjustment value corresponding to a last-sensed temperature among sensed temperatures sensed by said sensing unit over a predetermined period, and a second adjustment value corresponding to an average of the sensed temperatures sensed over said predetermined period; and said storage unit stores said first and second adjustment values.

18. The image forming apparatus device according to claim 15, wherein said storage unit stores a plurality of said adjustment values correlated to a plurality of temperature regions, respectively, and said control unit further determines which one of said plurality of temperature regions corresponds to the state at each point in time, based on the sensed temperature and controls temperature of said heating unit by using said adjustment value stored in said storage unit corresponding to the determined temperature region.

19. The image forming apparatus device according to claim 15, wherein said storage unit stores a table defining the adjustment value corresponding to said sheet portion, and said control unit determines said adjustment value corresponding to the sensed temperature with reference to said table.

20. The image forming apparatus device according to claim 15, wherein said control unit further determines whether the sensed temperature is the temperature in a temperature rising situation or the temperature in a temperature falling situation, said storage unit stores said adjustment value corresponding to the temperature rising situation, and stores said adjustment value corresponding to the temperature lowering situation and being independent of said adjustment value corresponding to the temperature rising situation, and said control unit obtains said adjustment value corresponding to a result of the determination by said time differential unit.

* * * * *